United States Patent [19]

Zimmerman

[11] Patent Number: 5,026,218

[45] Date of Patent: Jun. 25, 1991

[54] TEMPORARY ROOF SUPPORT CYLINDER

[75] Inventor: Joseph J. Zimmerman, Franklin, Pa.

[73] Assignee: Joy Technologies Inc., Pittsburgh, Pa.

[21] Appl. No.: 437,486

[22] Filed: Nov. 16, 1989

[51] Int. Cl.[5] ..... E21D 15/44

[52] U.S. Cl. ..... 405/290; 405/302; 405/291

[58] Field of Search ..... 405/290, 291, 299, 302; 91/170 MP; 248/354.1; 299/33

[56] References Cited

U.S. PATENT DOCUMENTS 3,371,901 3/1968 Groetschel ..... 405/290
4,252,475 2/1981 Cobb et al. ..... 405/291

FOREIGN PATENT DOCUMENTS 2032455 1/1972 Fed. Rep. of Germany ..... 405/290
390280 11/1973 U.S.S.R. ..... 405/290
870730 10/1981 U.S.S.R. ..... 405/290

*Primary Examiner*—David H. Corbin
*Attorney, Agent, or Firm*—Kirkpatrick & Lockhart

[57] ABSTRACT

A hydraulic temporary mine roof support cylinder is disclosed. The support cylinder includes an outer housing and a coaxial intermediate housing member and inner cylinder. A downwardly extending piston is provided between the outer housing and intermediate housing member. In addition, a sleeve piston is provided within the inner cylinder while an inner piston rod is extensible from the sleeve piston. Controls are provided for independently operating the lower cylinder and the upper cylinders. Additionally, a sequence/check valve ensures the timed operation of the upper cylinders. Due to the present design, each of the cylinders may be collapsed within the outer housing.

7 Claims, 7 Drawing Sheets

TEMPORARY ROOF SUPPORT CYLINDER

BACKGROUND OF THE INVENTION

1. Field of the Invention

The present invention relates to hydraulic cylinders, and, in particular, to hydraulic cylinders used to temporarily support the roof of a mine pending more permanent roof reinforcement.

2. Description of the Invention Background

As is well known in the underground mining industry, during mining operations a mining machine having a rotary cutting member is advanced into an area to be mined to remove material therefrom. Of course, the weight of the earth above the removed material must be supported to avoid collapse of the mine's roof. Typically, mining machines are provided with ancillary hydraulic cylinders which may temporarily support the mine roof, preferably during the advancement of the miner, until an approved permanent roof support, e.g., bolts, wooden posts, or cribbing, is installed.

Those skilled in the art are highly cognizant of the fact that much of the material to be mined which was formerly resident in relatively taller seams has heretofore been removed. As such, many mines currently being operated, and even more in the future, will face relatively lower coal seams. Due to the excessive costs associated with the mining and removal of unnecessary material, it is highly preferable for mining machines to only remove the minimum amount of material required from the seam. Necessarily, therefore, mining machines are constructed of lesser height to fit within such lower seams. Similarly, the temporary hydraulic roof support cylinders must be of compact height to fit within the lowest of seams. However, in certain areas of the mine, the temporary roof support cylinders must be capable of supporting considerably higher roofs. Accordingly, the competing interests of compact size, sufficient load-bearing capacity and sufficient extensibility have not been heretofore adequately addressed in the industry.

In addition, those skilled in the art recognize that it is important that temporary roof support cylinders be extensible both downwardly to engage the support surface of the mine floor, and upwardly to support the mine roof. However, it has been proven desirable that temporary mine roof support cylinders be independently extensible in the downward and upward directions. Heretofore, the art has been devoid of a temporary mine roof support cylinder which was of compact design yet of sufficient capacity, extensibility and flexibility of operation to meet the challenging needs of the industry.

The subject invention is directed toward an improved temporary mine roof support apparatus which overcomes, among others, the above-discussed concerns in the mining industry and which provides a high capacity, sufficient reach support cylinder in a compact, flexibly operable configuration.

SUMMARY OF THE INVENTION

In accordance with the present invention, there is provided a hydraulic temporary mine roof support cylinder. A plurality of the instant cylinders are preferably mounted on a mining machine and coupled to its source of pressurized hydraulic fluid.

The hydraulic cylinder disclosed includes an outer cylinder, an intermediate housing and an inner cylinder which are secured together. A lower first extensible piston is provided between the outer cylinder and the intermediate housing and includes internal hydraulic valving. A two-section control valve is provided having one section dedicated to the lower cylinder in order that it may be actuated independently.

A sleeve having a piston at one end thereof is separately provided within the inner cylinder. However, disposed within the sleeve is an inner piston rod. As such, the sleeve serves as a cylinder within which the inner piston rod may be extended under the control of a sequence/check valve provided in the lower end of the sleeve. Under the control of the second section of the control valve, the sequence valve serves to ensure that the sleeve is extended or retracted before the inner rod. In any event, however, the sleeve and inner rod may be operated completely independently of the lower piston, but the lower piston and the sleeve and inner rod may all be nested within the extent of the outer cylinder.

Accordingly, the present invention provides a design for a temporary mine roof support cylinder which meets each of the needs of the industry. As this invention provides a compact design, it may be employed in low mine heights. However, the instant cylinder is extensible to the required length and provides the necessary load-bearing capacity. Moreover, because the lower and upper pistons may be operated completely independently, the mining operation may proceed with utmost flexibility.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENT

Figure 1:
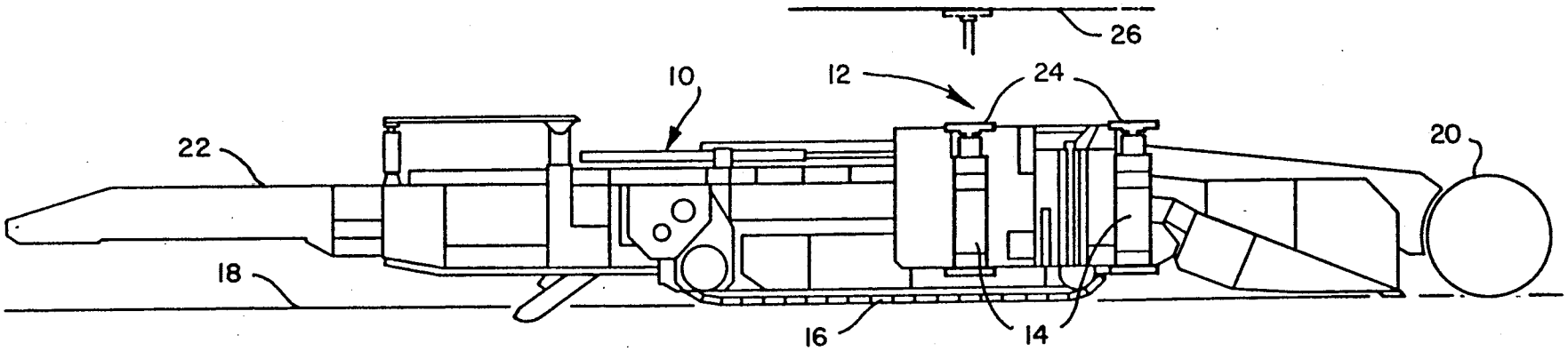
FIG. 1 is a side elevation view of a mining machine having temporary roof support cylinders.
Figure 2:
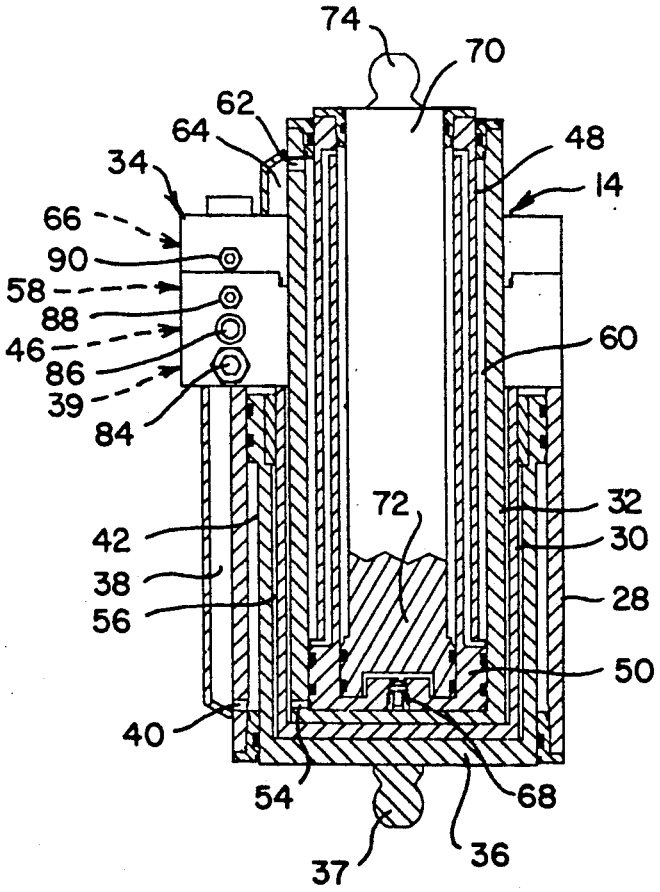
FIG. 2 is a side sectional view of the temporary roof support cylinder according to the present invention in its collapsed condition.
Figure 3:
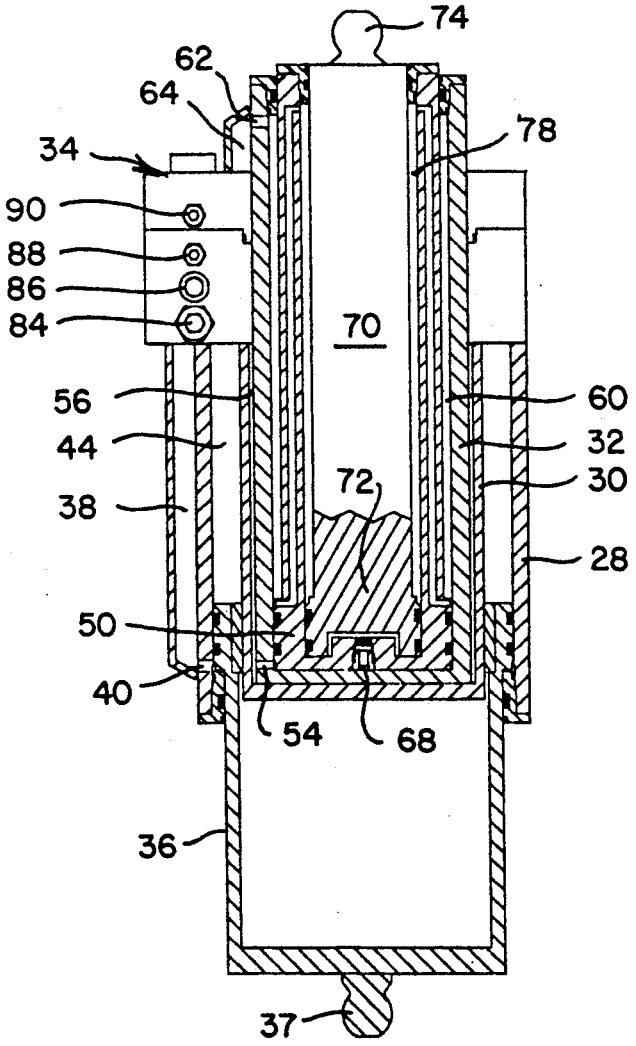
FIG. 3 is a side sectional view of the temporary roof support cylinder of this invention with its lower piston extended.
Figure 4:
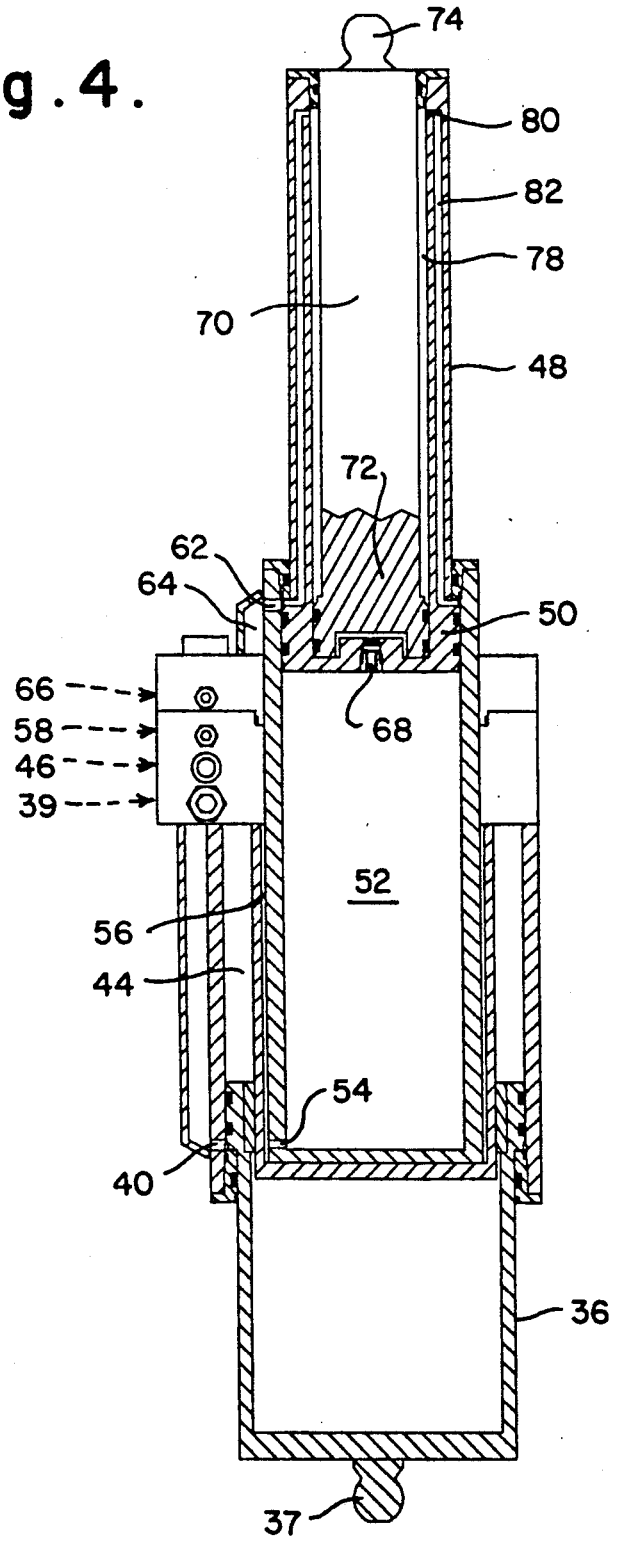
FIG. 4 is a side sectional view of the temporary roof support cylinder of the present invention with its lower piston and the upper sleeve extended.
Figure 5:
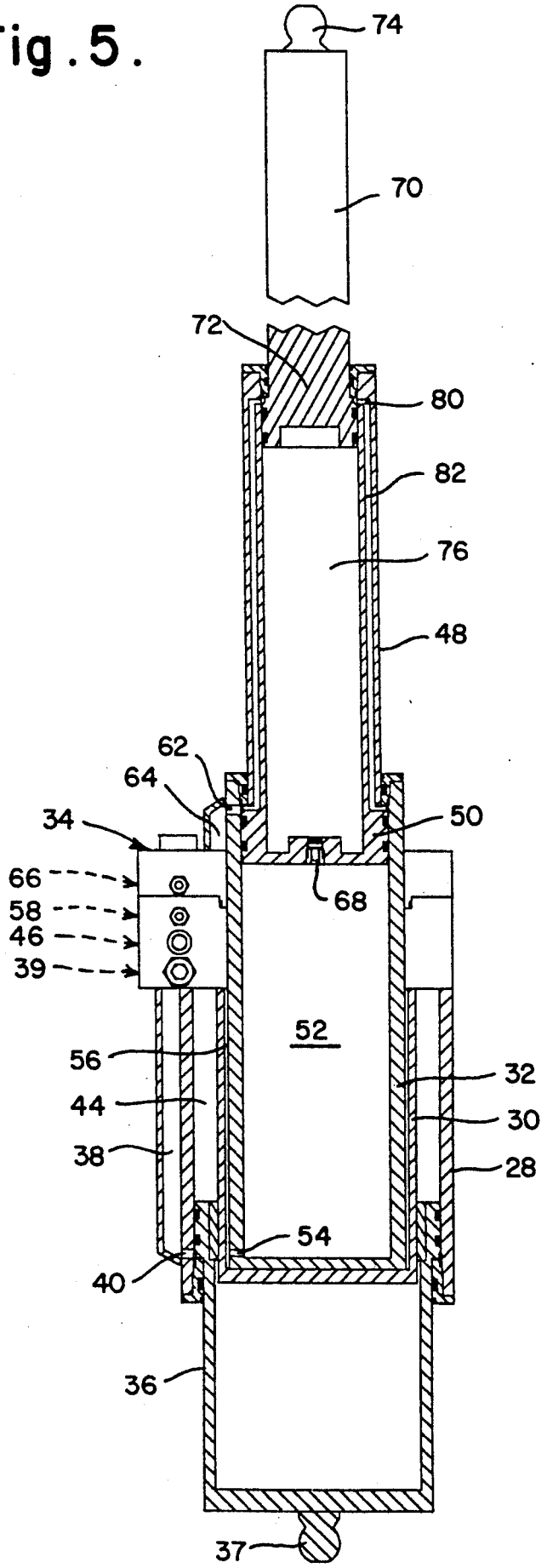
FIG. 5 is a side sectional view of the temporary roof support cylinder according to the invention showing complete extension including the inner piston rod.
Figure 6:
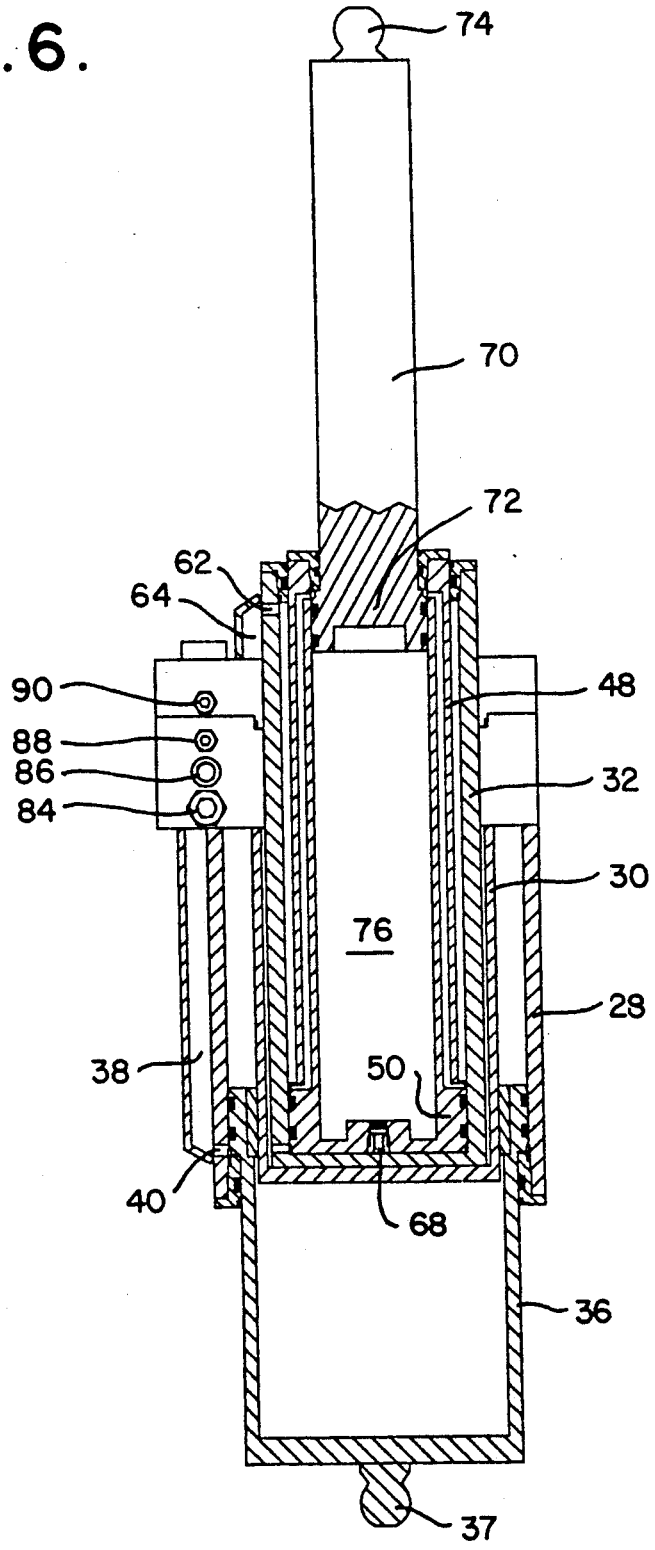
FIG. 6 is a side sectional view of the temporary roof support cylinder of the instant invention showing the upper sleeve retracted.

Referring now to the drawings wherein the showings are for purposes of illustrating the present preferred embodiment of the invention only and not for purposes of limiting same, the figures show an underground mining machine 10 which is provided with a temporary roof support apparatus 12 including hydraulic roof support cylinders 14.

More particularly and with reference to FIG. 1, there is shown a miner 10 propelled by tracks 16 along a mine floor, shown as 18. Miner 10 typically includes a rotatable cutting drum 20 to cut away material and a conveyor 22 to move such material to the rear of the miner. The roof support apparatus 12 includes a plurality of roof support cylinders 14 attached to a framework 24 which is mounted on, yet movable relative to, miner 10. As such, the roof support apparatus 12 may be placed in engagement with the floor and the mine roof 26 and the miner 10 advanced relative thereto.

The temporary roof support cylinders 14 each include a downwardly opening outer cylindrical housing 28, an upwardly opening intermediate housing member 30 coaxially disposed therein and an upwardly opening inner cylinder 32 coaxially disposed within the intermediate housing 30. The outer cylindrical housing 28 may be affixed to the framework 24 in any suitable manner as by bolting or welding. In addition, the valving for the support cylinder 14, described below, may be mounted in a valve housing 34 on the outer cylinder 28.

A downwardly extensible, lower first piston 36 is provided between the outer cylinder 28 and the intermediate housing 30. The lowermost end of first piston 36 includes a coupling 37 to which a foot plate for engaging the floor 18 may be attached. An external passageway 38 is provided on the side of outer cylinder 28 to communicate between a first interior port 39 in the valve housing 34 and an aperature 40 on the rod side 42 of piston 36, which is between piston 36 and outer cylinder 28. In addition, the piston side 44 of piston 36, which is between piston 36, outer cylinder 28 and intermediate housing 30, is coupled to a second interior port 46 in the housing 34.

Coaxially disposed within inner cylinder 32 is a sleeve 48 having a second piston 50 formed at its lowermost end. As such, the interior of inner cylinder 32 forms the piston side 52 of the second piston 50. In addition, bores 54 are formed in the base of inner cylinder 32 and communicate via passageways 56 with a third inner port 58 within valve housing 34. The rod side 60 of second piston 50 is formed between inner cylinder 32 and second piston 50. Bores 62 are provided in the upper end of inner cylinder 32 and are in communication with a passageway 64 which, in turn, communicates with a fourth inner port 66 in valve housing 34.

A sequence/check valve 68 is provided in the base of second piston 50 and serves to control the passage of hydraulic fluid between piston side 52 of second piston 50 and the interior of sleeve 48. Coaxially provided within and extending from sleeve 48 is a piston rod 70 having a piston 72 formed at the lowermost end thereof. The other end of piston rod 70 is provided with a coupling 74 which may receive a plate for engagement with the roof 26 of the mine. The interior of sleeve 48 forms the piston side 76 of the third piston 72 while the area between the interior of sleeve 48 and piston rod 70 forms the rod side 78 of third piston 72. In addition, bores 80 are provided in the remote end of sleeve 48 to communicate with passageways 82 formed along the length of sleeve 48 to allow communication between rod side 78 of third piston 72 and bores 62.

Figure 7:
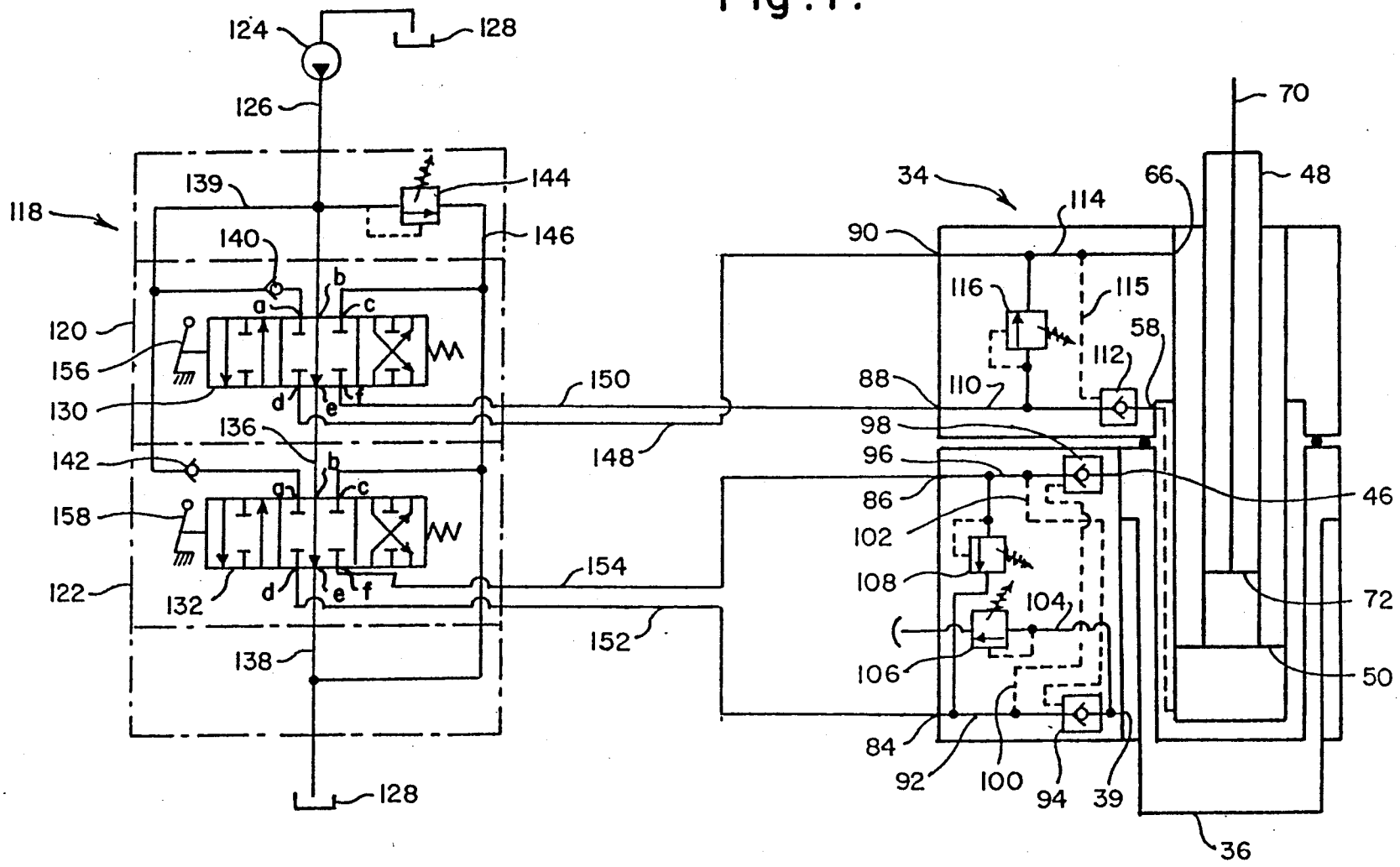
FIG. 7 is a schematic drawing of the hydraulic components of the invention.

Valve housing 34 is provided with four outer ports 84, 86, 88 and 90 respectively. As shown in FIG. 7, first outer port 84 is coupled to inner port 39 by means of a line 92 which includes a first pilot operated check valve 94. Second outer port 86 is in hydraulic connection with port 46 by means of line 96 which includes pilot operated check valve 98. In addition, pilot line 100 connects line 92 to operate the pilot feature of check valve 98 while pilot line 102 connects line 96 with pilot operated check valve 94. Line 104 is in hydraulic connection with inner port 39 and is coupled to atmospheric relief valve 106. In addition, a port relief valve 108 is coupled between lines 96 and 92, respectively.

Third outer port 88 is in hydraulic connection with inner port 58 by means of line 110 which includes pilot actuated check valve 112. Also, fourth outer port 90 is in communication with inner port 66 by means of line 114, while pilot line 115 passes to valve 112. Further, port relief valve 116 is in hydraulic communication with lines 110 and 114, respectively.

The actuation of cylinder 14 is controlled by a control valve 118 having a first section 120 and a second section 122. Control valve 118 is coupled to a hydraulic pump 124 by means of a line 126. In turn, the hydraulic pump 124 is hydraulically coupled to a tank or reservoir 128. The first section 120 and the second section 122 of control valve 118 each contain three- section valve spools 130 and 132, respectively. First valve spool 130 has ports **130*a*, 130*b* and 130*c* on one side thereof and ports 130*d*, 130*e* and 130*f* on the other side thereof. Similarly, second spool 132 has ports 132*a*, 132*b*, 132*c* on one side thereof and ports 132*d*, 132*e*, and 132*f* on the other side thereof. As such, line 126 from pump 124 is connected hydraulically to port 130*b* by means of line 134. Port 130*e* is connected to port 132*b* by line 136. Also, port 132*e* is connected to the tank 128 by means of line 138. Line 126 is connected hydraulically by line 139 to port 130*a* through a check valve 140 while line 139 is also connected to port 132*a* through a check valve 142. Line 126 is also connected via a relief valve 144 to line 146 which is also in communication with port 130*c*, port 132*c* and line 138**.

Port **130*d* is coupled to outer port 90 by line 148 while port 130*f* is coupled to outer port 88 by line 150. Similarly, port 132*d* is coupled to outer port 84 by line 152 and port 132*f* is connected to outer port 86 by line 154. Additionally, valve spool 130 may be displaced by the actuation of a lever 156 while valve spool 132 may be moved by means of a lever 158**.

As will be appreciated by those skilled in the art, the design for cylinder 14 and its associated controls allows for the independent or simultaneous operation of first piston 36 relative to second piston 50 and third piston 72. In the operation of cylinder 14, in order to extend first piston 36, valve spool 132 in the second section of 122 of control valve 118 is moved to the left as shown in FIG. 7 by valve actuator 158. This allows hydraulic fluid from pump 124 to flow through line 126, through line 139, through check valve 142, into port **132*a* and out through port 132*f*. Hydraulic fluid may then enter line 154 and pass to port 86 in valve housing 34. Hydraulic fluid then flows through line 96, through check valve 98, through port 46 and into the piston end 44 of first piston 36 thereby extending first piston 36. At the same time, pilot pressure from line 96 is transmitted through line 102 to open check valve 94 to allow hydraulic fluid in the rod end 42 of first piston 36 to flow through check valve 94 and through line 92 to port 84 and, hence, line 152, through port 132*d* to port 132*c*, to line 146 and to the tank 128**.

It will be additionally appreciated that port relief valve 108 is designed to control the extension of first piston 36 to minimize the force that can be applied by cylinder 14 between the mine roof 26 and the mine floor 18 and to prevent extensive pressure on the first piston 36. Atmospheric relief valve 106 is also incorporated between pilot check valve 94 and the rod end 42 to ensure that hydraulic pressure maintains within a safe limit should the cylinder 14 be incorrectly hydraulically piped.

In order to extend second piston 50, lever 156 is moved to the left as shown in FIG. 7 in order to move valve spool 130 to the left. This allows hydraulic fluid to enter port 130*a* from check valve 140 and pass to port 130*f*, through line 150 and to port 88 on valve housing 34. Hydraulic fluid then passes through line 110 and check valve 112 to port 58 and into the piston end 52 of second piston 50 to extend second piston 50. As the sleeve 48 and third piston 72 extend, hydraulic fluid from the rod end 60 will flow out through bores 62, through passageway 64 to port 66. Such hydraulic fluid then flows through line 114, through port 90 and line 148 to port 130*d* in valve spool 130, then through port 130*c* to line 146 and to tank 128.

The sequence check valve 68 ensures that the sleeve 48 will extend first and completely before the third piston 72 will extend. In particular, the sleeve/check valve 68 is designed to only allow flow into the piston side 76 upon the attainment of a predetermined hydraulic pressure. When the sequence/check valve 68 opens, hydraulic fluid enters the piston side 76 to extend the piston 72 and piston rod 70. Hydraulic fluid from the rod end 78 passes through bores 80, passageways 82 and out bores 62 into passageways 64 and is returned as outlined above to the tank 128.

In order to retract second piston 50 and third piston 72, valve spool 130 is moved to the right by the actuation of lever 156. This allows hydraulic fluid to pass from line 126 through check valve 140 through port 130*a* to port 130*d* and hence into line 148 to reach port 90. Hydraulic fluid then passes through line 114 to port 66 which is in communication with the rod end 60 of second piston 50. At the same time, pilot pressure in line 114 opens check valve 112 to allow hydraulic fluid to pass from the piston side 52, through bores 54 and channels 56 to port 58. Hydraulic fluid then passes through check valve 112, line 110 and through port 88 to line 150. Thereafter, the hydraulic fluid passes to port 130*f*, to port 130*c* and to line 146 from which it is deposited into the tank 128. The sequence check valve 68 traps oil in the piston end 76 of the third piston 72 which causes the sleeve 48 to retract first. Once the sleeve 48 retracts completely, it mechanically opens the sequence/check valve 68 to allow hydraulic fluid from piston end 76 to flow through bores 54 and back to tank 128 as outlined above.

When a mine roof 26 settles, there would be a pressure difference between the hydraulic pressure within piston side 52 of second piston 50 and piston side 76 of third piston 72. Without a check valve 68, this pressure would equalize by volumetric change between the two pistons. The sleeve 48 would extend relative to the main body, but the inner piston 72 would be pushed into the sleeve 48 at a greater rate. This would allow the mine roof 26 to be lowered and not properly supported; as such, check valve 68 serves a crucial function.

For the retraction of first piston 36, valve spool 132 is moved to the right by the actuation of control number 158. This allows hydraulic fluid to flow from pump 124, through line 126, through line 139, and through valve 142 to port 132*a*. Hydraulic fluid will then pass directly to port 132*d*, through line 152, through port 84, line 92, check valve 94 to port 39 and, hence, into passageway 38 and through bore 40 to the rod end 42 of first piston 36. At the same time, pilot pressure in line 92 would open check valve 98 to allow hydraulic fluid to flow from the piston side 44, through port 46 through check valve 98, line 96, port 86, line 154 to port 132*f*. Thereafter fluid would pass to port 132*c* and to line 146 for return to tank 128.

As will be readily apparent to those skilled in the art, the instant invention provides a compact, yet completely independently operable temporary roof support cylinder 14. Because of its design, the lower piston 36 may be operated independently and/or simultaneously relative to the second piston 50 and the third piston 72. Because the pistons may be nested within one another, a compact design is provided. However, because of the valve interconnections, various significant safety advantages are achieved.

It will be understood that various changes in the details, materials and arrangements of parts which have been herein described and illustrated in order to explain the nature of the invention may be made by those skilled in the art within the principal and scope of the invention as expressed in the appended claims.

What is claimed is:

1. A support jack apparatus, comprising:

a. an outer elongated member;

b. an inner elongated member disposed coaxially within and attached to said outer member so as to form a first chamber between said outer member and said inner member opening in a first direction, said inner member forming a second chamber opening in a second direction opposite from said first direction;

c. a first piston coaxially disposed within said first chamber, said first piston being mounted for longitudinal displacement relative to said outer member;

d. means for longitudinally displacing said first piston relative to said outer member;

e. a sleeve piston having a second piston, said sleeve piston being coaxially disposed within said inner member and mounted for longitudinal displacement relative thereto, said sleeve piston forming a third chamber opening in said second direction;

f. means for longitudinally displacing said sleeve piston relative to said inner member;

g. a piston rod having a third piston, said piston rod being coaxially disposed within said third chamber and mounted for longitudinal displacement relative thereto; and h. means for longitudinally displacing said piston rod relative to said sleeve piston.

2. Apparatus of claim 1 in which said means for longitudinally displacing said first piston is operable independently from said means for longitudinally displacing said sleeve piston or said means for longitudinally displacing said piston rod.

3. Apparatus of claim 1 in which said means for displacing said first piston comprises:

a. first means for introducing pressurized hydraulic fluid into said first chamber on one longitudinal side of said first piston to extend said first piston;

b. second means for introducing pressurized hydraulic fluid into said first chamber on the opposite longitudinal side of said first piston to retract said first piston; and c. means for controlling the supply of pressurized hydraulic fluid to said first or said second means for introducing.

4. Apparatus of claim 1 in which said means for displacing said sleeve piston comprises:

a. third means for introducing pressurized hydraulic fluid into said second chamber on one longitudinal side of said second piston to extend said sleeve piston;

b. fourth means for introducing pressurized hydraulic fluid into said second chamber on the opposite longitudinal side of said second piston to retract said sleeve piston; and c. means for controlling the supply of pressurized hydraulic fluid to said third or fourth means for introducing.

5. Apparatus of claim 1 in which said means for longitudinally displacing said piston rod comprises:

a. fifth means for introducing the supply of hydraulic fluid to said third chamber on one longitudinal side of said third piston to extend said piston rod;

b. sixth means for introducing pressurized hydraulic fluid into said third chamber on the opposite longitudinal side of said third piston to retract said piston rod; and c. means for controlling the supply of pressurized hydraulic fluid to said fifth or sixth means for introducing.

6. Apparatus of claim 5 in which said fifth means for introducing comprises a valve means for controlling the supply of hydraulic fluid from said second chamber to said third chamber on said one longitudinal side of said third piston.

7. Apparatus of claim 6 in which said valve means is configured to permit the passage of hydraulic fluid from said second chamber to said third chamber on said one side of said third piston only upon the complete extension of said sleeve piston and to permit the passage of hydraulic fluid from said third chamber on said one side of said third piston to said second chamber only upon the complete retraction of said sleeve piston.

* * * * *